US010427422B2

(12) United States Patent
Nakazawa

(10) Patent No.: US 10,427,422 B2
(45) Date of Patent: Oct. 1, 2019

(54) PRINTING APPARATUS AND PRINTING METHOD OF PRINTING APPARATUS

(71) Applicant: CASIO COMPUTER CO., LTD., Shibuya-ku, Tokyo (JP)

(72) Inventor: Masaya Nakazawa, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/821,551

(22) Filed: Nov. 22, 2017

(65) Prior Publication Data

US 2018/0178557 A1 Jun. 28, 2018

(30) Foreign Application Priority Data

Dec. 27, 2016 (JP) ..... 2016-252539

(51) Int. Cl.
*B41J 11/00* (2006.01)
*B41J 3/36* (2006.01)

(52) U.S. Cl.
CPC ..... *B41J 11/008* (2013.01); *B41J 3/36* (2013.01)

(58) Field of Classification Search
CPC ..... B41J 3/36; B41J 3/39
See application file for complete search history.

(56) References Cited

U.S. PATENT DOCUMENTS 5,927,872 A * 7/1999 Yamada ..... B41J 2/36 400/88
2007/0076082 A1* 4/2007 Cook ..... B41J 3/36 347/109

FOREIGN PATENT DOCUMENTS

| | | | |
|---|---|---|---|
| JP | 01184156 | A | 7/1989 |
| JP | 06127030 | A | 5/1994 |
| JP | 09327946 | A | 12/1997 |
| JP | 10035034 | A | 2/1998 |
| JP | 10086453 | A | 4/1998 |
| JP | 11058847 | A | 3/1999 |
| JP | 2006224356 | A | 8/2006 |
| JP | 2008055680 | A | 3/2008 |
| JP | 2008062453 | A | 3/2008 |
| JP | 2008068513 | A | 3/2008 |

OTHER PUBLICATIONS

Japanese Office Action (and English language translation thereof) dated Jul. 17, 2018 issued in Japanese Application No. 2016-252539.

* cited by examiner

*Primary Examiner* — Julian D Huffman
(74) *Attorney, Agent, or Firm* — Holtz, Holtz & Volek PC

(57) ABSTRACT

A printing apparatus includes a movement amount acquiring device which acquires a movement amount of the printing apparatus with respect to a printing medium, a printer which performs printing on the printing medium, and a processor. The processor adjusts a length of a print image to be printed on the printing medium to a value not exceeding a length of a print area set on the printing medium along a first direction, on the basis of the movement amount acquired by the movement amount acquiring device when the printing apparatus is moved relative to the print area along the first direction, and performs control such that the print image with its length adjusted is printed on the printing medium when the printing apparatus is moved relative to the print area along a second direction different from the first direction.

15 Claims, 10 Drawing Sheets

PRINTING APPARATUS AND PRINTING METHOD OF PRINTING APPARATUS

BACKGROUND OF THE INVENTION

1. Field of the Invention

The present invention relates to a hand-held and hand-operated printing apparatus and a printing method of the printing apparatus.

2. Description of the Related Art

A printing apparatus which is capable of printing a desired print image on a printing medium, such as a sheet of paper or a box, while being held with a user's hand and moved in a scanning direction to slide on the printing medium is conventionally known. Such a printing apparatus is described, for example, in Japanese Patent Application Laid-Open No. 2008-55680. The printing apparatus of this type is advantageous in that it eliminates the need to set a sheet of paper and it is capable of printing freely in any desired position on the printing medium.

The printing apparatus of this type, however, performs no print area setting according to the paper size or the like. As this allows printing in any place, there was a case where the printed image spreads out of a desired print area or falls outside the sheet of paper during printing.

BRIEF SUMMARY OF THE INVENTION

According to an embodiment of the present invention, in a printing apparatus that is held and operated by a user to move on a printing medium for printing an image on the printing medium, the image can be printed within a desired print area.

To achieve the above advantage, the printing apparatus according to the present invention includes:

a movement amount acquiring device which acquires a movement amount of the printing apparatus with respect to a printing medium;

a printer which performs printing on the printing medium; and a processor which is operable to adjust a length of a print image to be printed on the printing medium along a first direction to a value that does not exceed a length of a print area which is set on the printing medium along the first direction, on the basis of the movement amount acquired by the movement amount acquiring device when the printing apparatus is moved relative to the print area along the first direction, and cause the printer to print the print image whose length has been adjusted on the printing medium when the printing apparatus is moved relative to the print area along a second direction that is different from the first direction.

To achieve the above advantage, in a printing method of a printing apparatus according to the present invention, the printing apparatus includes a movement amount acquiring device which acquires a movement amount of the printing apparatus with respect to a printing medium, and a printer which performs printing on the printing medium, and the method includes the steps of:

adjusting a length of a print image to be printed on the printing medium along a first direction to a value that does not exceed a length of a print area which is set on the printing medium along the first direction, on the basis of the movement amount acquired by the movement amount acquiring device when the printing apparatus is moved relative to the print area along the first direction; and causing the printer to print the print image whose length has been adjusted on the printing medium when the printing apparatus is moved relative to the print area along a second direction that is different from the first direction.

BRIEF DESCRIPTION OF THE SEVERAL VIEWS OF THE DRAWING

FIGS. 5A, 5B, and 5C are diagrams illustrating operations of the handheld printer at the time of printing, FIG. 5A illustrating the time of determining a printing start position, FIG. 5B illustrating the time of designating the length of a print area (time of determining a printing end position), and FIG. 5C illustrating the time of performing printing;

DETAILED DESCRIPTION OF THE INVENTION

Figure 1:
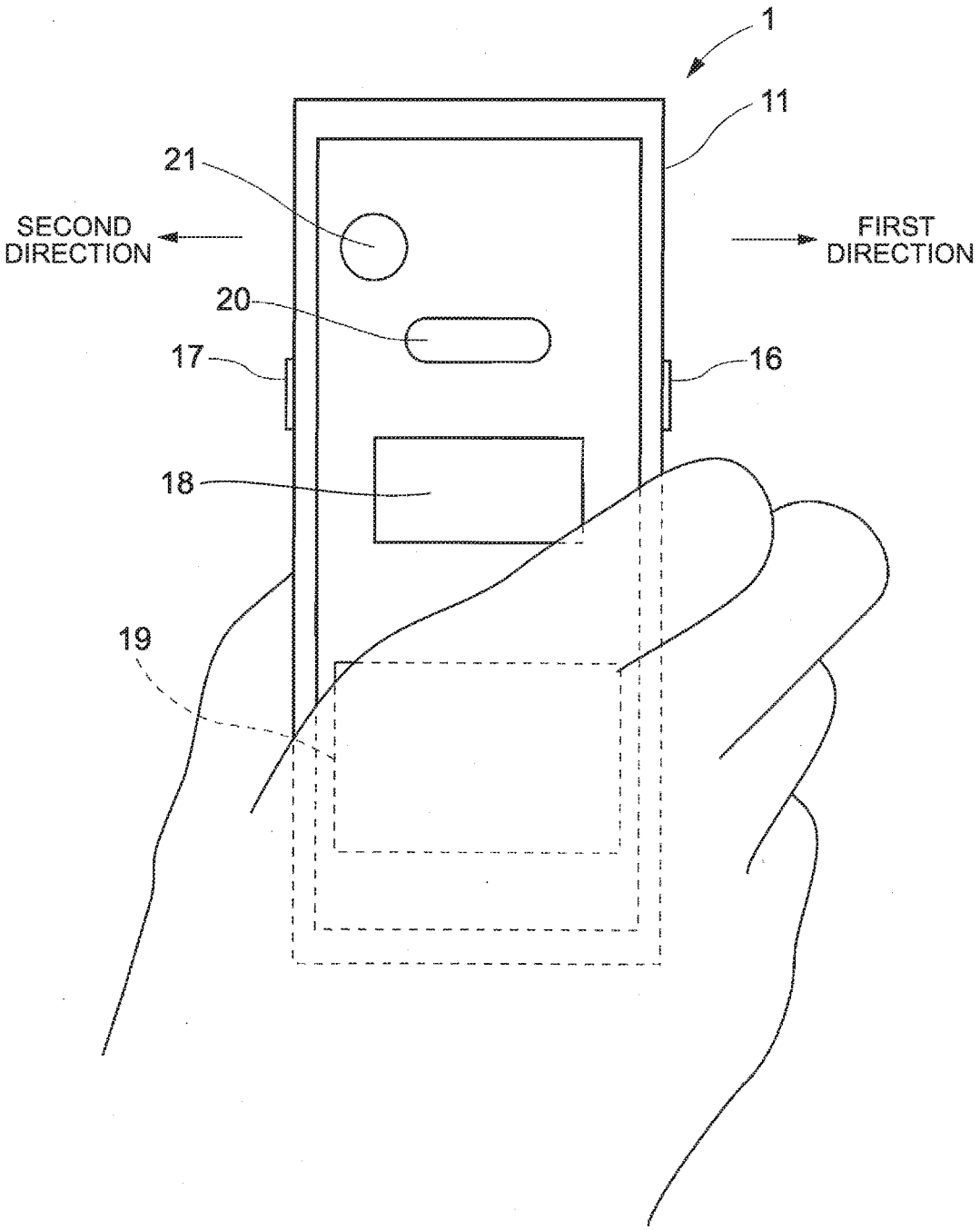
FIG. 1 is a plan view of a handheld printer according to an embodiment of the present invention.

Modes for implementing the present invention (hereinafter, referred to as "embodiments") will be described in detail with reference to the drawings.

Throughout the description of the embodiments, the same elements are denoted by the same reference numerals.

[Configuration of Handheld Printer]

FIG. 1 is a plan view of a handheld printer (printing apparatus) 1 according to an embodiment of the present invention.

Figure 2:
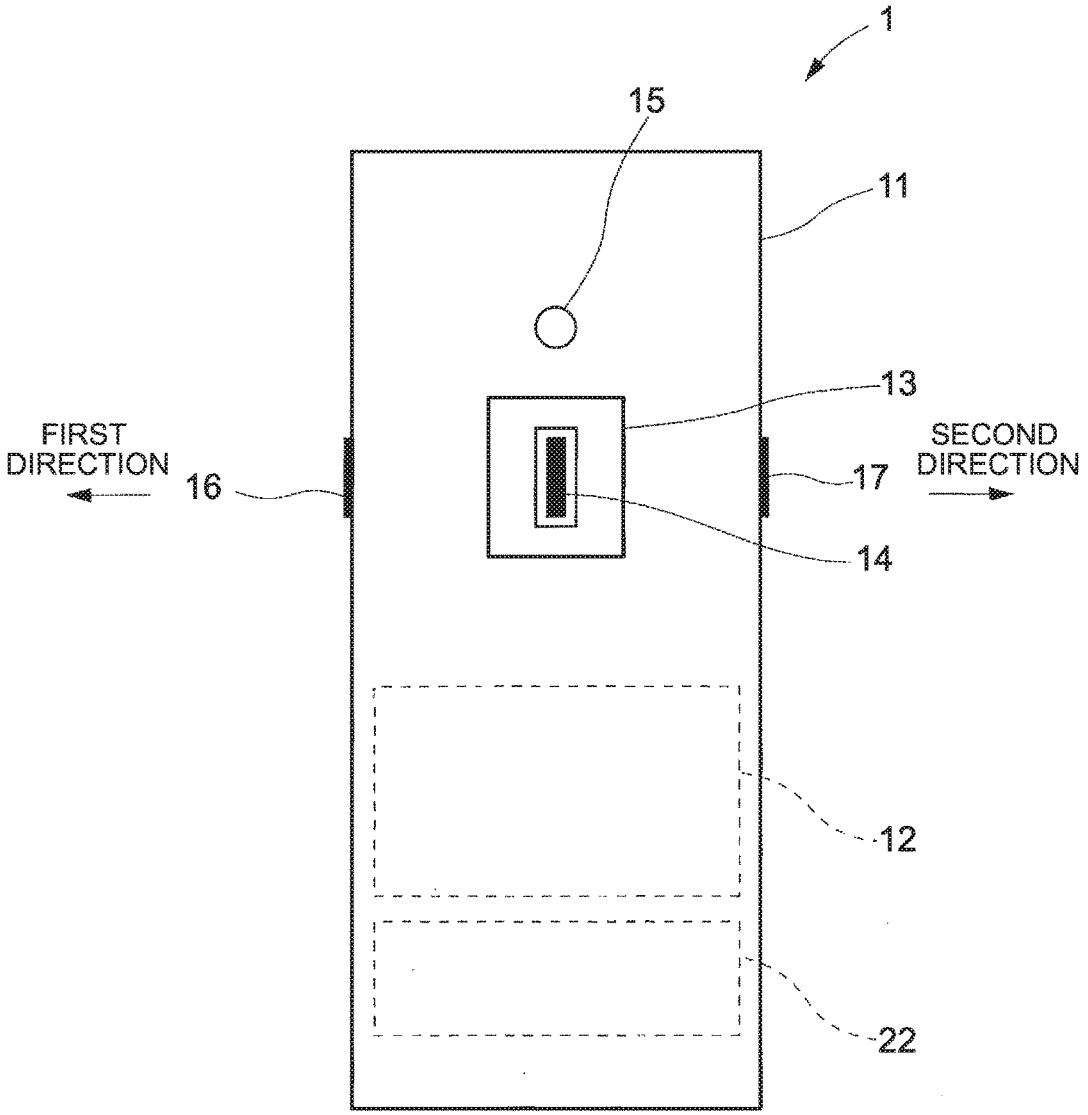
FIG. 2 is a bottom view of the handheld printer according to the embodiment of the present invention.

FIG. 2 is a bottom view of the handheld printer 1 according to the embodiment of the present invention.

The handheld printer 1 is a printing apparatus which is held and operated by a user to scan (move) on a printing medium for printing a desired print image on the printing medium.

It is noted that the scanning direction from a start point toward an end point of a print area, which is preset on a printing medium, will be referred to as a first direction (left-to-right direction in FIG. 1), and the scanning direction from the end point toward the start point of the print area will be referred to as a second direction (right-to-left direction in FIG. 1). The second direction includes a direction substantially opposite to the first direction.

It is only necessary for the handheld printer 1 to move relatively to a printing medium. For example, a printing medium may be moved, with the handheld printer 1 fixed in place.

As shown in FIGS. 1 and 2, the handheld printer 1 includes: a casing 11, a substrate 12, an ink cartridge 13 with a printer head 14, an optical sensor 15, a printing start point marker 16, a printing end point marker 17, a liquid crystal panel 18, a keyboard 19, a printing instruction button 20, a power button 21, and a built-in power supply 22.

The casing 11 is an enclosure for housing the substrate 12, the ink cartridge 13, the optical sensor 15, the built-in power supply 22, and others. As shown in FIG. 1, the casing 11 has a shape allowing a user to easily hold and operate it for scanning.

Figure 3:
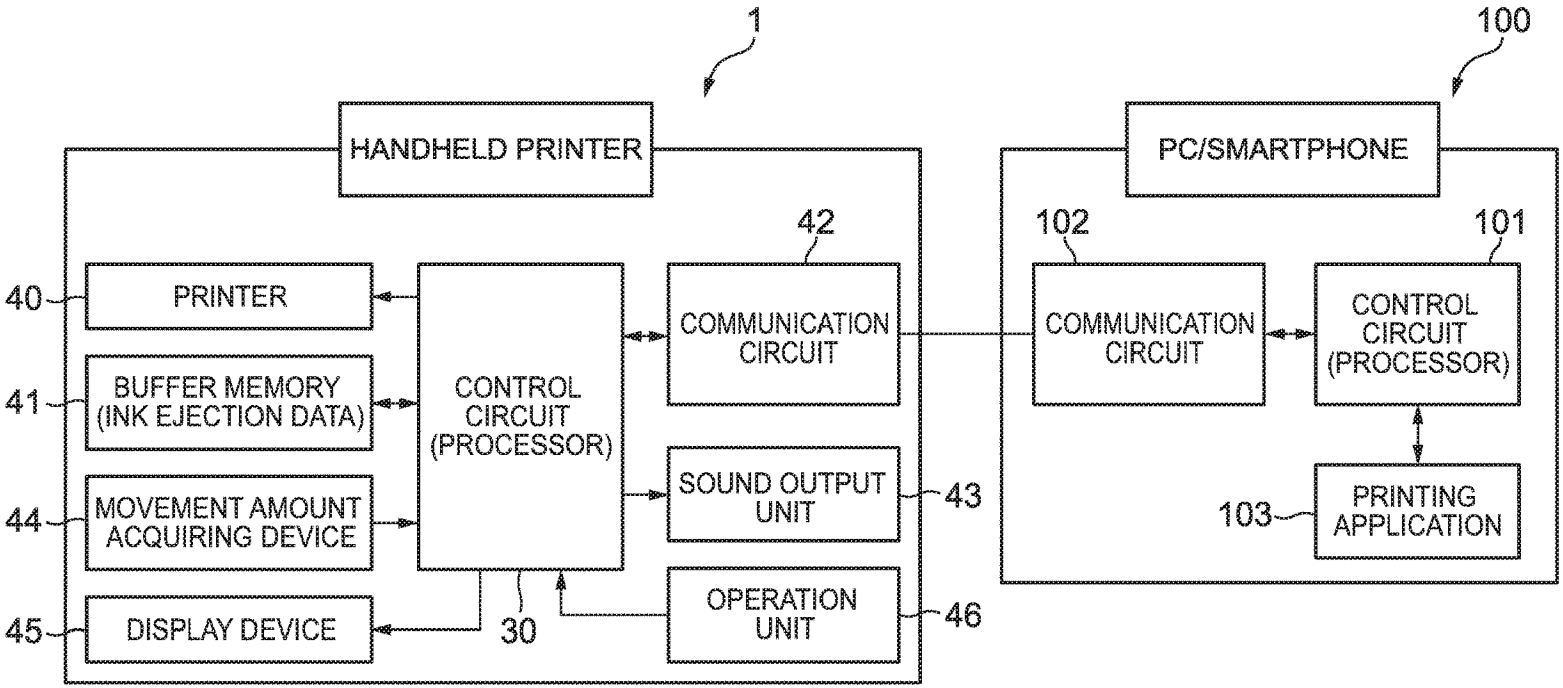
FIG. 3 is a block diagram showing functional configurations of a handheld printer and an external terminal according to an embodiment of the present invention.

The substrate 12 has mounted thereon electronic components (CPU, RAM, ROM, IC, etc.) constituting a control circuit 30, a buffer memory 41, a communication circuit 42, and a sound output unit 43, which are shown in FIG. 3.

The functions of the control circuit 30, the buffer memory 41, the communication circuit 42, and the sound output unit 43 will be described later.

The ink cartridge 13, storing ink therein, is provided integrally with the printer head 14, which ejects ink onto a printing medium for printing.

The ink cartridge 13 is disposed in the handheld printer 1 so that the printer head 14 is located on a surface (here, the bottom surface) opposing a printing medium, thereby constituting a printer 40 (see FIG. 3) that performs printing.

The printer head 14 has a large number of nozzles arranged in a line, for example, in a direction orthogonal to the scanning direction. The ink is ejected from these nozzles.

In the case of offering color printing, nozzle arrays for a plurality of colors (of cyan, magenta, and yellow, for example) are arranged side by side in the scanning direction.

The handheld printer 1 may have a removable cap for preventing drying of the ink stuck to the printer head 14.

The handheld printer 1 may further have, as an attachment thereto, a cradle on which the handheld printer 1 when not in use is placed for preventing drying of the ink stuck to the printer head 14.

The optical sensor 15 corresponds to a movement amount acquiring device 44 (see FIG. 3) which acquires at least a movement distance of the handheld printer 1 at each prescribed sampling period. For example, the optical sensor 15 may be an optical type sensor that is equipped with a laser or an LED and is capable of acquiring a movement direction and a movement distance, like the one used generally in a mouse for a PC. The optical sensor 15 may be one that does not acquire the movement direction.

In the present embodiment, the optical sensor 15 is arranged so that a measurement unit for acquiring the movement direction and the movement distance is located on the bottom surface side of the handheld printer 1.

It should be noted that the movement amount acquiring device 44 is not necessarily limited to the optical type sensor; it may be, for example, of a mechanical type such as a rotary encoder.

The printing start point marker 16 is a mark used by a user, when performing printing on a printing medium, for positioning the handheld printer 1 at a printing start position p of a print area preset on the printing medium.

The printing start point marker 16 in the present embodiment is arranged at the right end of the casing 11, in front of the printer head 14 in the first direction.

The operation method following the positioning of the handheld printer 1 will be described later.

The printing end point marker 17 is a mark used by a user for positioning the handheld printer 1 at a printing end position q of the print area, when measuring a distance (hereinafter, referred to as "measured distance" or "length L of the print area" as appropriate) from the printing start position p to the printing end position q of the print area.

The printing end point marker 17 in the present embodiment is arranged at the left end of the casing 11, in front of the printer head 14 in the second direction.

The operation method at the time of measuring the distance from the printing start position p to the printing end position q of the print area will be described later.

The printing start point marker 16 and the printing end point marker 17 each desirably have a light emitting unit made of a light source such as an LED, and also have a function of guiding the scanning direction of the handheld printer 1 with turning on and off of the light emitting unit.

The printing start point marker 16 and the printing end point marker 17 each desirably have a width in a direction orthogonal to the scanning direction that is equal to a maximum width (effective printing width) of the printer head 14, so as to allow a user to correctly understand the printing width of a print image.

The liquid crystal panel 18, the keyboard 19, and the printing instruction button 20 constitute a display device 45 and an operation unit 46 (see FIG. 3) serving as user interfaces, which perform a guiding operation or an error notification operation in accordance with an instruction from the control circuit 30, and also detect a user operation and input the same to the control circuit 30.

The power button 21 is an operation button for a user to power on and off the handheld printer 1.

The built-in power supply 22 is, for example, a dry-cell battery or secondary battery, which serves as a power source for the handheld printer 1.

[Functional Configurations of Handheld Printer and External Terminal]

The functional configurations of the handheld printer 1 and an external terminal 100 will be described with reference to FIG. 3.

It should be noted that, while an external terminal 100, such as a PC or a smartphone, excellent in display function, operation function, and computing function is utilized in the present embodiment for generating a print image and for adjusting a length of the print image by size adjustment thereof, it may be configured such that the processing performed in the external terminal 100 in the present embodiment is performed in the handheld printer 1 instead.

FIG. 3 is a block diagram showing the functional configurations of the handheld printer 1 and the external terminal 100 according to an embodiment of the present invention.

As shown in FIG. 3, the handheld printer 1 has functional units including a control circuit 30, a printer 40, a buffer memory 41, a communication circuit 42, a sound output unit 43, a movement amount acquiring device 44, a display device 45, and an operation unit 46.

For the printer 40, the movement amount acquiring device 44, the display device 45, and the operation unit 46, the previous descriptions are incorporated here.

The control circuit 30 in the handheld printer 1 is a functional unit that controls overall operations of the handheld printer 1, and includes a processor in the form of a CPU, a ROM, a RAM, and so on.

The detailed operations of the control circuit 30 in the handheld printer 1 will be described later.

The buffer memory 41 stores print data for use in printing a print image.

The print data is ink ejection data for the printer head 14, arranged in units of dots corresponding to the movement amount of the handheld printer 1.

For printing of a print image, the control circuit 30 transfers the ink ejection data from within the buffer memory 41 to the printer 40, successively in accordance with the movement distance of the handheld printer 1 acquired by the movement amount acquiring device 44, to cause the printer 40 to perform printing.

The communication circuit 42 includes a radio communication unit, such as a Wi-Fi device, for example, capable of communicating with an external terminal 100.

This allows the print data for use in printing in the handheld printer 1 to be generated, not by the handheld printer 1, but by an external terminal 100 having a favorable environment for data generation, and the print data generated by the external terminal 100 to be read into the handheld printer 1.

In the present embodiment, the distance from a printing start position p to a printing end position q of a print area, measured by the handheld printer 1, is transmitted to the external terminal 100, which in turn performs length adjustment by size adjustment of the print data. The handheld printer 1 then performs printing on the basis of the print data, having undergone the length adjustment, transferred from the external terminal 100.

The sound output unit 43 constitutes a user interface, together with the liquid crystal panel 18, the keyboard 19, and the printing instruction button 20, and performs a guiding operation or an error notification operation in accordance with an instruction from the control circuit 30.

As shown in FIG. 3, the external terminal 100 has functional units including a control circuit 101, a communication circuit 102, and a printing application 103.

The control circuit 101 in the external terminal 100 is a functional unit that controls overall operations of the external terminal 100, and includes a processor in the form of a CPU, a ROM, a RAM, and so on.

The detailed operations of the control circuit 101 in the external terminal 100 will be described later.

The communication circuit 102 includes a radio communication unit, such as a Wi-Fi device, for example, capable of communicating with the handheld printer 1.

The printing application 103 is a dedicated application that causes the external terminal 100 to function as a print image generating device and a print image length adjustment device for the handheld printer 1. The detailed operations of the printing application 103 will be described later.

[Basic Operations of Handheld Printer and External Terminal]

The basic operations of the handheld printer 1 and the external terminal 100 will be described with reference to FIGS. 4, 5A, 5B, and 5C.

Figure 4:
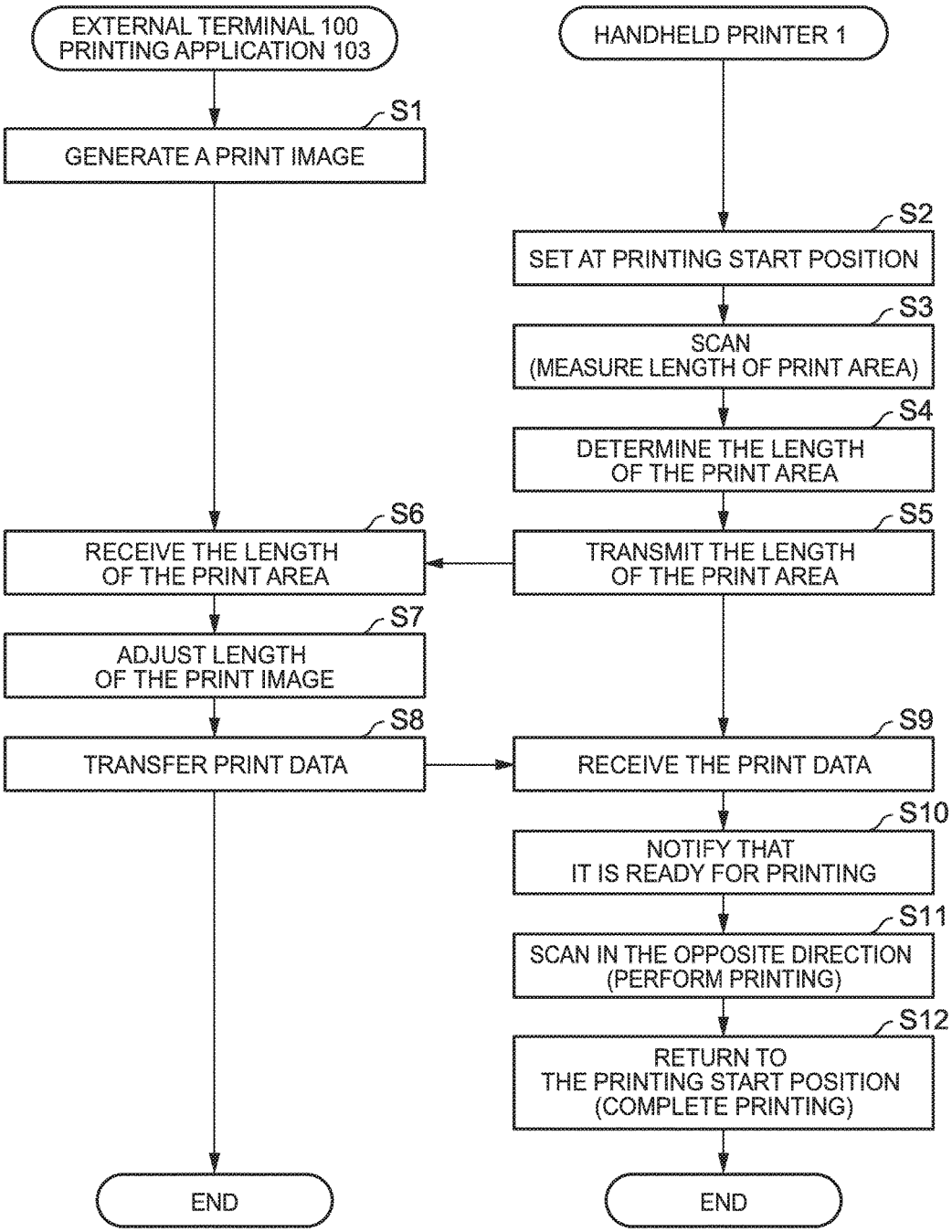
FIG. 4 is a flowchart illustrating basic operations of the handheld printer and the external terminal (printing application)

FIG. 4 is a flowchart illustrating the basic operations of the handheld printer 1 and the external terminal 100 (printing application 103).

Figure 5A:
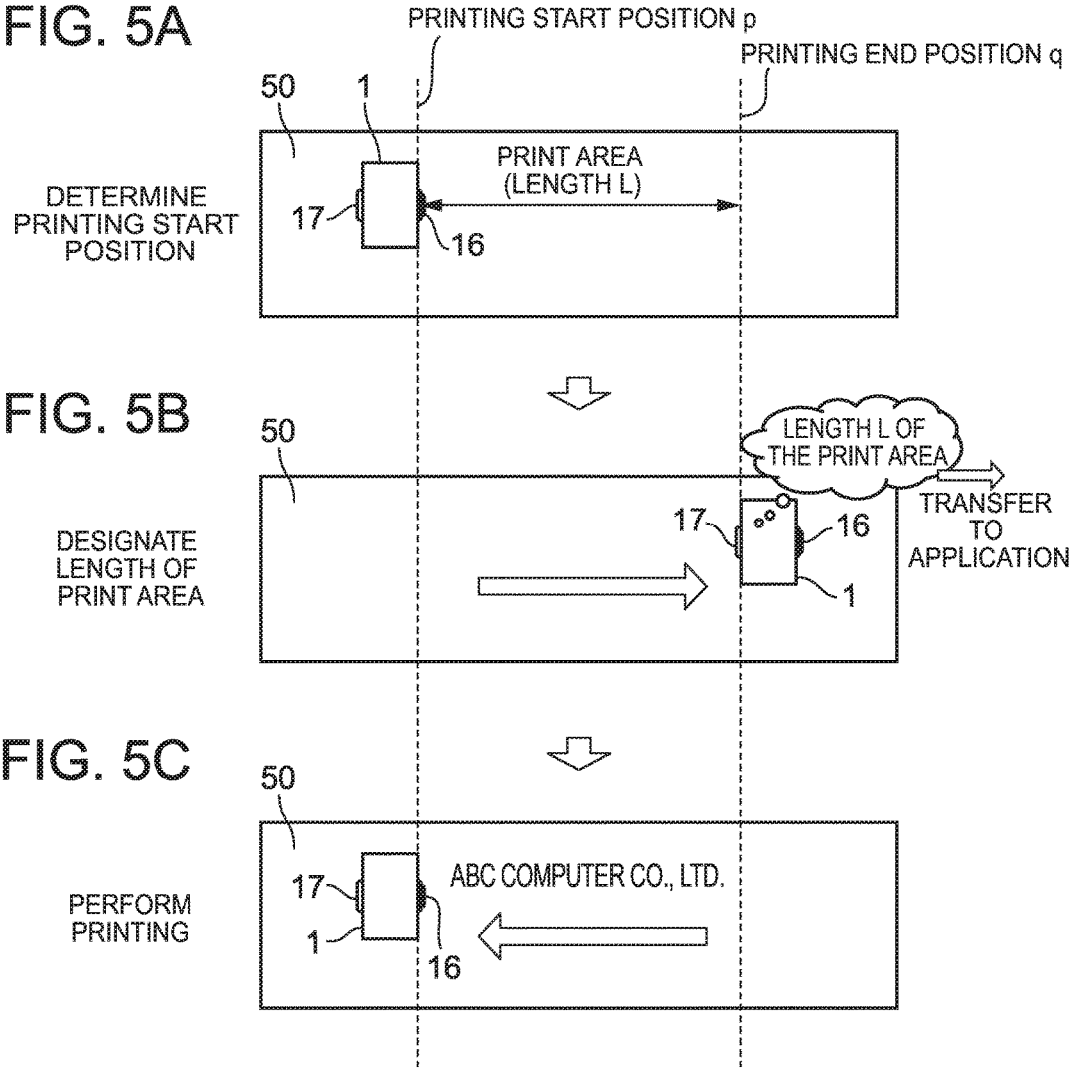

FIGS. 5A, 5B, and 5C are diagrams illustrating the operations of the handheld printer 1 at the time of printing, FIG. 5A illustrating the time of determining a printing start position p, FIG. 5B illustrating the time of designating the length of a print area (time of determining a printing end position q), and FIG. 5C illustrating the time of performing printing.

As shown in FIG. 4, when performing printing with the handheld printer 1, a user firstly starts the printing application 103 in the external terminal 100 to generate a print image (S1 in FIG. 4).

While the print image generated here may be any print image including text and/or an image, it should not exceed a preset maximum printing length Lmax and maximum printing width Wmax. The print image is formed in the first direction which is a direction from the start point toward the end point of the print area.

The maximum printing length Lmax is set on the basis of the capacity of the buffer memory 41, and the maximum printing width Wmax is set on the basis of the maximum width (effective printing width) of the printer head 14.

When the generation of the print image in the external terminal 100 is finished, the user sets the handheld printer 1 at a printing start position p of a printing medium 50, with the printing application 103 kept running (S2 in FIG. 4; FIG. 5A).

This setting operation can be performed easily by aligning the printing start point marker 16 (see FIG. 1) of the handheld printer 1 with the printing start position p on the printing medium 50.

Next, the user causes the handheld printer 1 to scan from the printing start position p to the printing end position q, so as to measure the distance from the printing start position p to the printing end position q, or, the length L in the scanning direction of the print area (S3 in FIG. 4; FIG. 5B).

Specifically, after pressing the printing instruction button 20 at the printing start position p, the user causes the handheld printer 1 to scan from the printing start position p toward the printing end position q. When the printing end point marker 17 has reached the printing end position q, the user finishes the scanning by the handheld printer 1 and presses the printing instruction button 20 again.

It should be noted that the printing start position p and the printing end position q can be specified in another operation method in which the user keeps pressing the printing instruction button 20 while causing the handheld printer 1 to scan from the printing start position p to the printing end position q.

The handheld printer 1 obtains, from a movement amount acquired by the optical sensor 15 during the scanning by the handheld printer 1 in step S3, the length L of the print area (L=acquired movement amount−lateral width of the casing) (S4 in FIG. 4). The obtained length L of the print area is transmitted to the external terminal 100 (S5 in FIG. 4).

On the external terminal 100 side, the length L of the print area is received (S6 in FIG. 4). The size of the print image is then adjusted in accordance with the received length L of the print area, so that the length of the print image in the movement direction of the handheld printer 1 is adjusted in agreement with the length L of the print area, to take a value not exceeding that length L of the print area (S7 in FIG. 4).

The print image with its length adjusted is then converted into print data, and the resultant data is transferred to the handheld printer 1 (S8 in FIG. 4).

This print data is ink ejection data for printing the print image from the printing end position q toward the printing start position p.

The handheld printer 1 receives the print data adjusted in length (S9 in FIG. 4). The handheld printer 1 then notifies the user that the printer is now ready for printing (S10 in FIG. 4).

This notification can be made, for example, with a sound output from the sound output unit 43, a display by the display device 45, illumination of the printing end point marker 17, etc.

When confirming from the notification that the printer is ready for printing, the user causes the handheld printer 1 to scan from the printing end position q toward the printing start position p, to perform printing (S11 in FIG. 4; FIG. 5C).

Here, the control circuit 30 in the handheld printer 1 causes the printer head 14 to start printing, triggered by a reversal of the movement direction acquired by the movement amount acquiring device 44. It should be noted that the control circuit 30 in the handheld printer 1 may be configured to cause the printer head 14 to start printing, not just when triggered by the reversal of the movement direction acquired by the movement amount acquiring device 44, but in response to a user operation performed to indicate that the movement direction of the handheld printer 1 has been reversed, for example.

Subsequently, the handheld printer 1, while acquiring by the optical sensor 15 the movement from the printing end position q toward the printing start position p, reads the print data from the buffer memory 41 in order corresponding to the movement direction of the handheld printer 1 and transfers the print data to the printer head 14, in accordance with the acquired movement distance, to cause the printer head 14 to perform printing (S11 in FIG. 4; FIG. 5C). As a result, the print image is printed in a direction along the first direction.

The printing by the printer head 14 is finished once the handheld printer 1 has returned to the printing start position p (S12 in FIG. 4).

According to the basic operations of the handheld printer 1 and the external terminal 100 as described above, the control circuit 30 measures the length L of the print area, which is the length in the movement direction of the print area in the printing medium 50, on the basis of the result acquired by the movement amount acquiring device 44, and, on the basis of the measured length L of the print area, the length in the movement direction of a print image to be printed on the printing medium 50 is adjusted to take a value not exceeding the length L of the print area. This will bring about a printed result that is adjusted in length to fall within the print area defined by the printing start position p, where the handheld printer 1 is firstly set, and the printing end position q, designated when measuring the length L of the print area.

When the direction from the printing start position p toward the printing end position q of the print area is represented as a first direction and the direction from the printing end position q toward the printing start position p as a second direction, the control circuit 30 measures the length L of the print area on the basis of the result acquired by the movement amount acquiring device 44 while the movement amount acquiring device 44 is moved on the printing medium 50 in one of the first and second directions, and controls printing by causing the printer 40 to print the adjusted print image on the printing medium 50 while the printer 40 is moved on the printing medium 50 in the other of the first and second directions. Stated differently, measuring the length L of the print area and printing are carried out with the consecutive scanning in one reciprocal motion of the handheld printer 1. This prevents an undesirable event that the printing start position p is shifted from the originally set position, which would occur when, for example, the length L of the print area is measured with scanning by the handheld printer 1 from the printing start position p to the printing end position q and the handheld printer 1 is set again at the printing start position p to perform printing with scanning from the printing start position p to the printing end position q.

[Processing when Crossing Maximum Printing Length]

A description will now be made, with reference to FIGS. 6A and 6B, about a processing operation in the case where the movement distance of the handheld printer 1 has exceeded a maximum printing length Lmax in measurement of the length L of the print area.

Figure 6A:
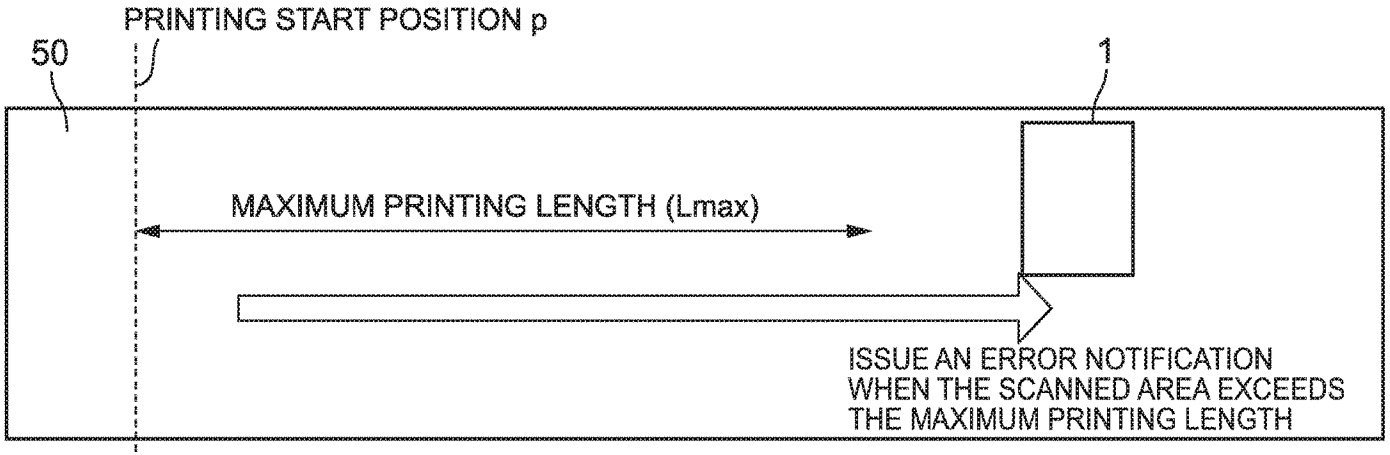
FIGS. 6A and 6B are diagrams illustrating operations of the handheld printer upon occurrence of crossing of a maximum printing length, FIG. 6A illustrating an error notification operation performed when a crossing of the maximum printing length has occurred, and FIG. 6B illustrating an error cancellation notification operation performed when the crossing of the maximum printing length has been cancelled.
Figure 6B:
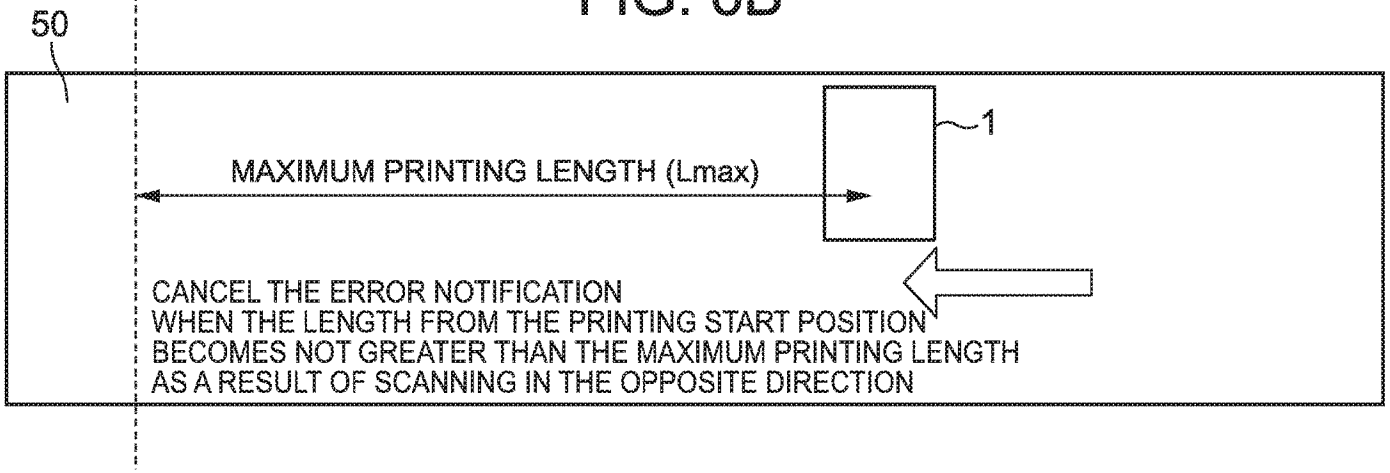

FIGS. 6A and 6B are diagrams illustrating the operations of the handheld printer 1 upon occurrence of crossing of the maximum printing length Lmax, FIG. 6A illustrating an error notification operation performed when a crossing of the maximum printing length Lmax has occurred, and FIG. 6B illustrating an error cancellation notification operation performed when the crossing of the maximum printing length Lmax has been cancelled.

As shown in FIG. 6A, in measurement of the length L of the print area, the control circuit 30 of the handheld printer 1 issues an error notification to the user when the movement distance of the handheld printer 1 by the user, i.e. the length of the print area, has exceeded a preset maximum printing length Lmax.

The error notification may be made, for example, by outputting a warning sound from the sound output unit 43.

In measurement of the length L of the print area, it is desirable that the handheld printer 1 sums up the movement amounts in the first direction from the printing start position p toward the printing end position q of the handheld printer 1 by the user, while subtracting the movement amounts in the opposite, second direction.

With this configuration, when the movement distance of the handheld printer 1 by the user has exceeded the maximum printing length Lmax, the handheld printer 1 can be moved backward in the second direction so that the movement distance falls within the maximum printing length Lmax, as shown in FIG. 6B. With cancellation of the error notification, the user can recognize that the movement distance of the handheld printer 1 now falls within the maximum printing length Lmax.

The printing end position q is then designated as the user stops the handheld printer 1 at a given location within the maximum printing length Lmax and presses the printing instruction button 20.

[Processing of Adjusting the Length of Print Data]

A description will now be made, with reference to FIGS. 7 and 8, about the processing of adjusting the length of a print image in the external terminal 100 (printing application 103).

Figure 7:
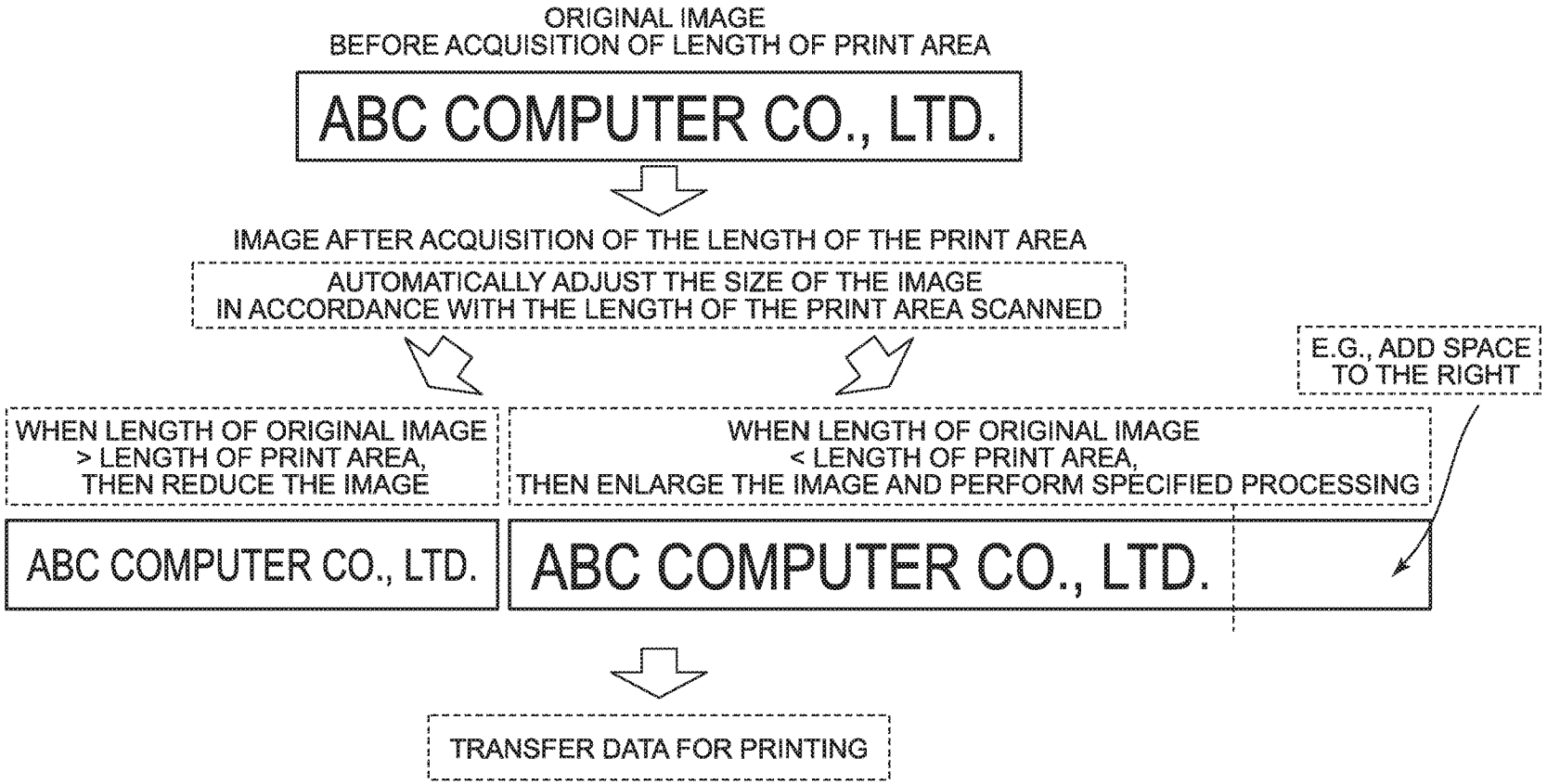
FIG. 7 is a diagram illustrating processing, performed by the external terminal (printing application), of adjusting the length of a print image according to the length (measured distance) of the print area.

FIG. 7 illustrates processing, performed by the external terminal 100 (printing application 103), of adjusting the length of a print image according to the length (measured distance) L of the print area.

As shown in FIG. 7, in the case where the length in the scanning direction of the print image (original image) prior to the length adjustment processing is greater than the length L of the print area, the control circuit 101 in the external terminal 100 reduces the print image to a size that falls within the print area.

This reduction processing is performed while maintaining the aspect ratio of the original print image.

On the other hand, in the case where the length in the scanning direction of the print image prior to the length adjustment processing is smaller than the length L of the print area, the external terminal 100 enlarges the print image, while maintaining the aspect ratio of the print image, so as to cause the length in the scanning direction of the print image to approach the length L of the print area, within the area where the height of the print image does not exceed a maximum printing width Wmax. That is, supposing that the print image is enlarged, with its aspect ratio kept unchanged, such that the length in the scanning direction of the print image agrees with or almost agrees with the length L of the print area, if the height of the enlarged print image will not exceed the maximum printing width Wmax, then the print image is enlarged until the length in the scanning direction of the print image agrees with or almost agrees with the length L of the print area. On the other hand, supposing that the print image is enlarged, with its aspect ratio kept unchanged, such that the length in the scanning direction of the print image agrees with or almost agrees with the length L of the print area, if the height of the enlarged print image will exceed the maximum printing width Wmax, then the print image is enlarged just until the height of the print image agrees with or almost agrees with the maximum printing width Wmax. A space is then added to the enlarged print image, to make the length in the scanning direction of the enlarged print image, together with the space added thereto, agree with or almost agree with the length L of the print area. That is, the length in the scanning direction of the space to be added is equal to a difference between the length L of the print area and the length in the scanning direction of the adjusted print image. Further, in the case where the print image before being subjected to length adjustment has a height equal to the maximum printing width Wmax, no size adjustment processing is performed on the print image; rather, a space is added to the print image so as to make the length in the scanning direction of the print image, together with the space added thereto, agree with the length L of the print area. In this case, the length in the scanning direction of the space to be added is equal to a difference between the length L of the print area and the length in the scanning direction of the print image.

Stated differently, in the case where a print image has a length smaller than the length L of the print area, the control circuit 101 in the external terminal 100 enlarges the print image to a size that falls within the print area and that can be printed by the printer 40.

Then, in the case where the length of the enlarged print image is smaller than the length L of the print area, the control circuit 101 in the external terminal 100 adds to the enlarged print image a space corresponding to the difference between the length L of the print area and the length of the enlarged print image. The control circuit 101 then performs control such that the enlarged print image, with the space added thereto, is printed within the print area.

Figure 8:
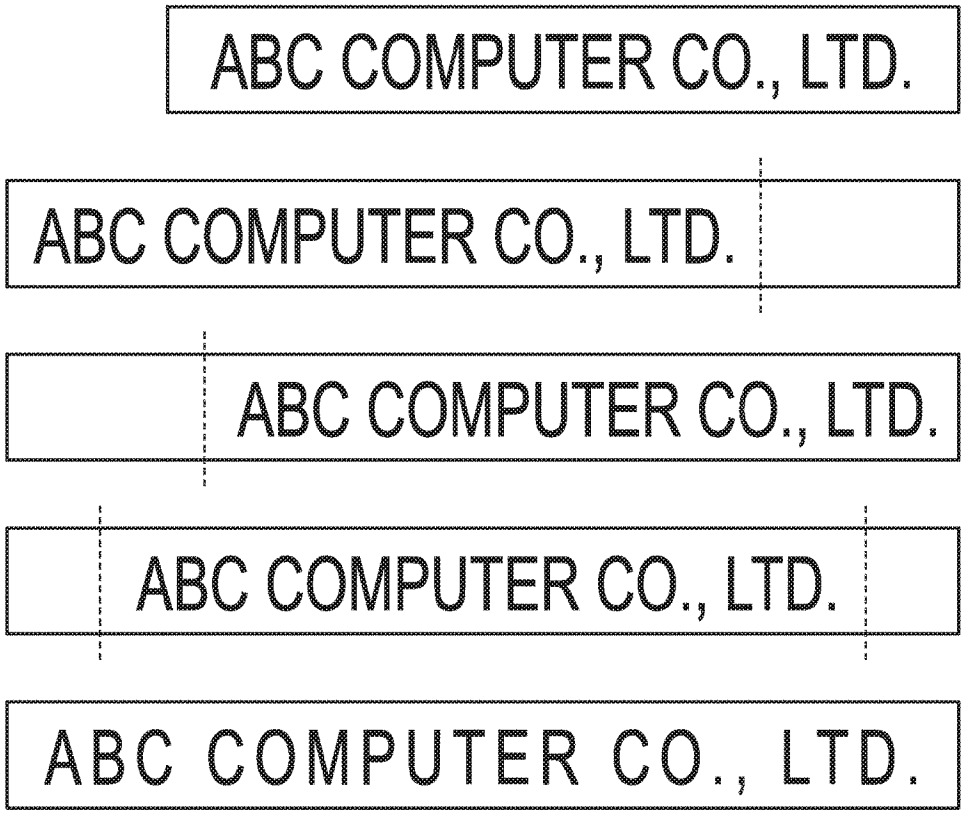
FIG. 8 is a diagram illustrating processing, performed by the external terminal (printing application), of adjusting a space according to the length (measured distance) of the print area.

FIG. 8 illustrates exemplary ways of adding a space in space adjustment processing, performed by the external terminal 100 (printing application 103), in which a space is added in accordance with the length (measured distance) L of the print area.

As shown in FIG. 8, the space adjustment processing of adding a space to a print image has the following modes, one of which is selected by a user:

(1) Flush left, where a space is added to the right of the print image;

(2) Flush right, where a space is added to the left of the print image;

(3) Centered, where spaces are added to both sides of the print image; and (4) Justified (applicable only to text data), where spaces are equally added between the letters constituting the print image.

For example, in the case of adding a space to a print image, the external terminal 100 of the present embodiment provides a user with previews of printed results which will be obtained when adopting the above space adjustment processing (space adjustment patterns (1) to (4)), and performs the length adjustment of the print image in the space adjustment mode selected by the user.

It should be noted that a certain space adjustment mode may be set as default, and the default space adjustment mode may be selected automatically.

[Processing Procedure on Handheld Printer Side]

A description will now be made, with reference to FIG. 9, about the processing procedure of the control circuit 30 that implements the above-described operations of the handheld printer 1.

Figure 9:
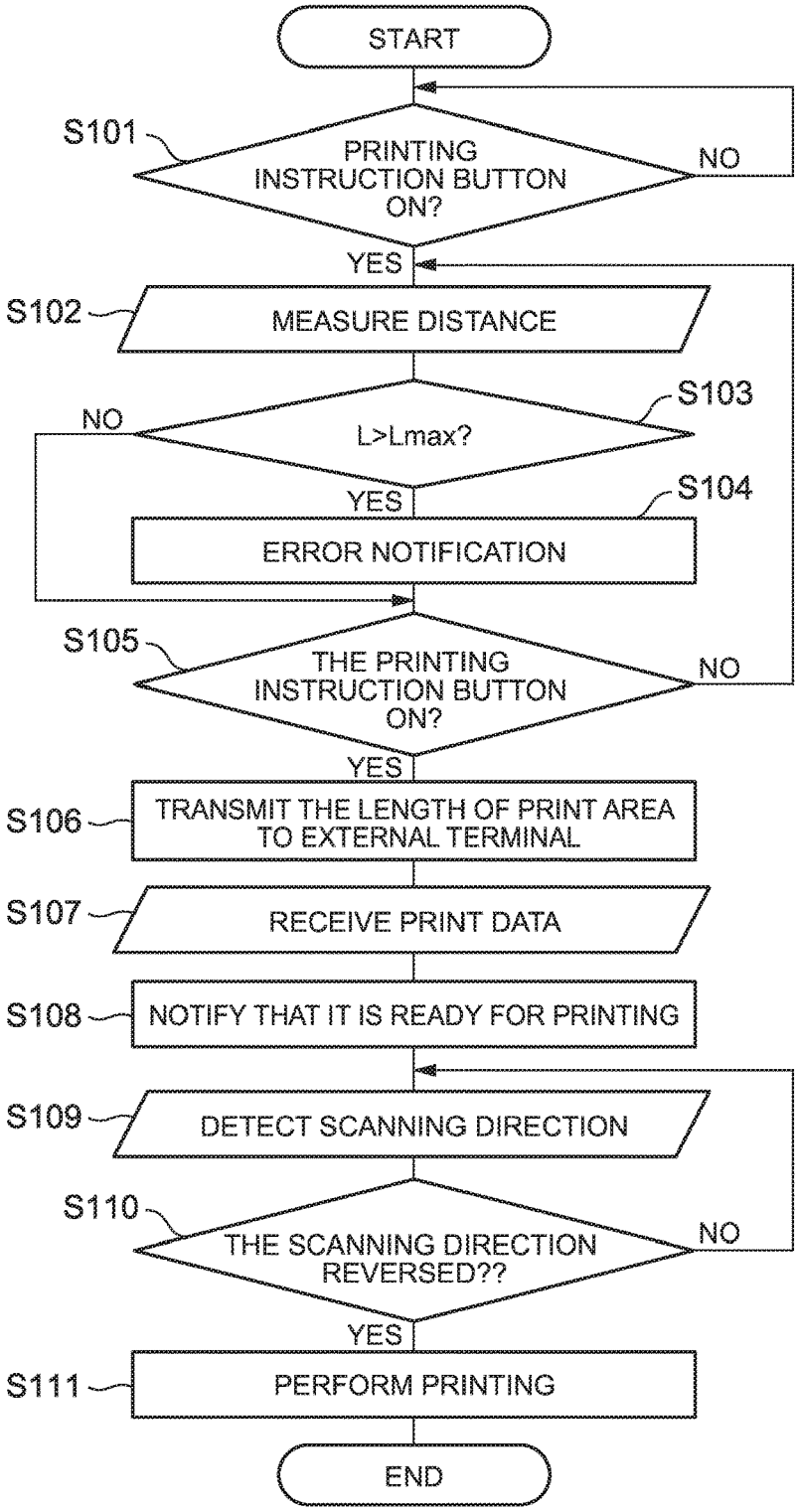
FIG. 9 is a flowchart illustrating the processing procedure on the handheld printer side.

FIG. 9 shows the processing procedure of the control circuit 30 in the state where the power button 21 of the handheld printer 1 has been turned on and a print mode of performing printing has been selected.

FIG. 9 is a flowchart illustrating the processing procedure in the control circuit 30 on the handheld printer 1 side.

As shown in FIG. 9, the control circuit 30 of the handheld printer 1 firstly determines an operation of the printing instruction button 20 at a printing start position p (S101).

This determination is repeated until the printing instruction button 20 is operated.

In the case where the printing instruction button 20 is operated and the determination result in step S101 becomes YES, the control circuit 30 starts processing of measuring a distance from the printing start position p to a printing end position q (or, the length L of a print area) (S102).

Specifically, the control circuit 30 sums up the movement amounts in the first direction from the printing start position p toward the printing end position q of the handheld printer 1 by the user, while subtracting the movement amounts in the opposite, second direction.

This distance measurement processing is repeated until the printing instruction button 20 is operated at the printing end position q (S105).

While executing the distance measurement processing, the control circuit 30 determines whether the movement distance of the handheld printer 1 by the user has exceeded the maximum printing length Lmax (S103). If the determination result is YES, the control circuit 30 issues an error notification to the user (S104).

If it is determined that the printing instruction button 20 has been operated at the printing end position q (YES in step S105), the control circuit 30 determines the print area, and transmits the measured length L of the print area to the external terminal 100 (S106).

Next, the control circuit 30 receives from the external terminal 100 the print data with the length adjusted in accordance with the length L of the print area (S107). The control circuit 30 then notifies the user that it is ready for printing (S108).

The print data provided from the external terminal 100 is the ink ejection data for printing the print image from the printing end position q toward the printing start position p.

Next, while detecting the scanning direction of the handheld printer 1 (S109), the control circuit 30 repeatedly determines whether the scanning direction has been reversed (S110).

Specifically, it is determined whether the scanning of the handheld printer 1 from the printing end position q toward the printing start position p has been started.

If the determination result becomes YES, printing is carried out, on the basis of the print data with the length adjusted, from the printing end position q toward the printing start position p (S111).

[Processing Procedure on External Terminal Side]

A description will now be made, with reference to FIG. 10, about the processing procedure of the printing application 103 that implements the above-described operations of the external terminal 100.

Figure 10:
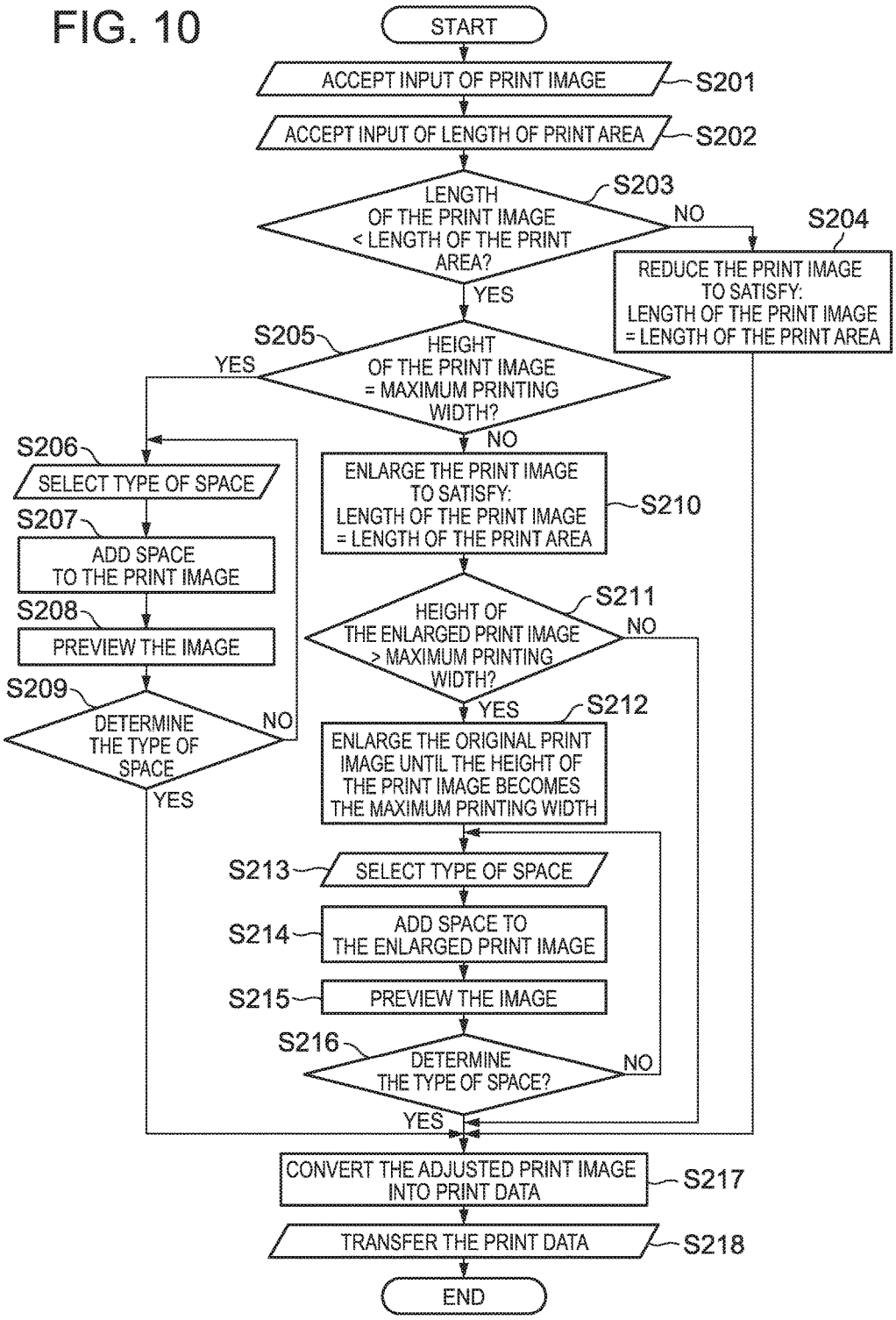
FIG. 10 is a flowchart illustrating the processing procedure on the external terminal (printing application) side.

FIG. 10 shows the processing procedure for adjusting the length of a print image, which is performed after the length L of the print area is received from the handheld printer 1.

FIG. 10 is a flowchart illustrating the processing procedure in the control circuit 101 on the external terminal 100 (printing application 103) side.

As shown in FIG. 10, when receiving the length L of the print area from the handheld printer 1, the printing application 103 accepts an input of a print image (S201) and accepts the input of the length L of the print area (S202).

Then, it is determined whether the length in the scanning direction of the print image is smaller than the length L of the print area (S203).

If the determination result is NO, i.e. when the length of the print image is greater than the length L of the print area, then the print image is reduced, with its aspect ratio kept unchanged, such that the length in the scanning direction of the print image agrees with or almost agrees with the length L of the print area (S204).

On the other hand, if it is determined that the length of the print image is smaller than the length L of the print area (YES in S203), it is determined whether the height of the print image is equal to a maximum printing width Wmax (S205).

If the determination result is YES, the user is caused to select the type of space (S206), the space of the selected type is added to the print image (S207), and the resultant image is previewed (S208). This series of processing is repeated until the user performs the operation of determining the type of space (S209).

On the other hand, if it is determined that the height of the print image is not equal to the maximum printing width Wmax (NO in S205), the print image is enlarged, with its aspect ratio kept unchanged, such that the length in the scanning direction of the print image agrees with or almost agrees with the length L of the print area (S210).

It is then determined whether the height of the enlarged print image is greater than the maximum printing width Wmax (S211).

If it is determined that the height of the enlarged print image is greater than the maximum printing width Wmax (YES in S211), the original print image is enlarged until the height of the print image becomes equal to or almost equal to the maximum printing width Wmax (S212).

Then, the user is caused to select the type of space (S213), the space of the selected type is added to the enlarged print image (S214), and the resultant image is previewed (S215). This series of processing is repeated until the user performs the operation of determining the type of space (S216).

Following the step S204, or following the user operation of determining the space type in step S209, or following the user operation of determining the space type in step S216, the adjusted print image is converted into print data (S217). The resultant print data is then transferred to the handheld printer 1 (S218).

While the handheld printer 1 of the present invention has been described on the basis of the particular embodiment, the present invention is not limited to the particular embodiment described above. Various modifications and improvements thereto are within the technical scope of the present invention, as will be apparent to those skilled in the art from the recitation in the claims.

For example, in the above-described embodiment, the length L of the print area was measured during the rightward scanning of the handheld printer 1, and the printing was performed during the leftward scanning of the handheld printer 1. Alternatively, the length L of the print area may be measured during the leftward scanning of the handheld printer 1, and the printing may be performed during the rightward scanning of the handheld printer 1.

The scanning directions of the handheld printer 1 are not limited to the right and left directions, but may be the up and down directions or oblique directions.

In the case where the height of the print image is smaller than the maximum printing width Wmax, several options may be provided regarding the vertical position of the print image, for causing it to be aligned top, aligned bottom, or vertically centered within the print area.

What is claimed is:

1. A printing apparatus comprising:

a movement amount acquiring device which acquires a movement amount of the printing apparatus with respect to a printing medium;

a printer which performs printing on the printing medium; and a processor which is operable to:

adjust a length of a print image to be printed on the printing medium along a first direction to a value that does not exceed a length of a print area which is set on the printing medium along the first direction, the length of the print area being set based on a first movement amount acquired by the movement amount acquiring device when the printing apparatus is moved relative to the print area along the first direction; and cause the printer to print the print image whose length has been adjusted on the printing medium when the printing apparatus is moved relative to the print area along a second direction that is different from the first direction, the print image being printed on the printing medium so as to extend in a direction along the first direction, wherein in causing the printer to print the print image, the processor reads print data of the print image whose length has been adjusted in an order corresponding to the second direction when the printing apparatus is moved relative to the print area along the second direction, wherein the processor outputs an error notification when the first movement amount has exceeded a preset printing length, and wherein the processor cancels the error notification when an acquired length becomes equal to or less than the preset printing length as the printing apparatus is moved in the second direction after the first movement amount has exceeded the preset printing length, the acquired length being acquired by subtracting a second moving amount, which is an amount by which the printing apparatus is moved in the second direction after the first movement amount has exceeded the preset printing length, from the first moving amount.

2. The printing apparatus according to claim 1, wherein, with one of a direction from a printing start position toward a printing end position in the print area and a direction from the printing end position toward the printing start position in the print area being set as the first direction and the other as the second direction, the processor is operable to:

acquire the length of the print area based on a result acquired by the movement amount acquiring device when the movement amount acquiring device is moved on the printing medium in the first direction; and cause the printer to print the print image whose length along the first direction has been adjusted on the printing medium while the printer is moved on the printing medium in the second direction.

3. The printing apparatus according to claim 1, wherein:

the movement amount acquiring device is capable of acquiring a movement direction with respect to the printing medium when the printing apparatus is moved relative to the printing medium, the second direction is a direction substantially opposite to the first direction, and the processor causes the printer to start printing when the movement direction acquired by the movement amount acquiring device is reversed.

4. The printing apparatus according to claim 1, wherein in a case where the length of the print image is greater than the length of the print area, the processor reduces the print image to a size falling within the print area, while maintaining an aspect ratio of the print image.

5. The printing apparatus according to claim 1, wherein in a case where the length of the print image is smaller than the length of the print area and a height of the print image is smaller than a maximum value of a size printable by the printer, the processor enlarges the print image to a size falling within the print area and printable by the printer, while maintaining an aspect ratio of the print image.

6. The printing apparatus according to claim 5, wherein in a case where the length of the enlarged print image is smaller than the length of the print area, the processor adds to the enlarged print image a space corresponding to a difference between the length of the print area and the length of the enlarged print image, and controls the printer to print the enlarged print image, with the space added thereto, within the print area.

7. The printing apparatus according to claim 6, wherein the processor has a plurality of modes in which the space is arranged in different positions from each other with respect to the print image, and arranges the space with respect to the print image in accordance with a specific mode selected from the plurality of modes.

8. The printing apparatus according to claim 1, wherein in a case where the length of the print image is smaller than the length of the print area and a height of the print image is equal to a maximum value of a size printable by the printer, the processor adds to the print image a space corresponding to a difference between the length of the print area and the length of the print image, and controls the printer to print the print image, with the space added thereto, within the print area.

9. The printing apparatus according to claim 8, wherein the processor has a plurality of modes in which the space is arranged in different positions from each other with respect to the print image, and arranges the space with respect to the print image in accordance with a specific mode selected from the plurality of modes.

10. A printing method of a printing apparatus, the printing apparatus including a movement amount acquiring device which acquires a movement amount of the printing apparatus with respect to a printing medium, and a printer which performs printing on the printing medium, the method comprising:

adjusting a length of a print image to be printed on the printing medium along a first direction to a value that does not exceed a length of a print area which is set on the printing medium along the first direction, the length of the print area being based on a first movement amount acquired by the movement amount acquiring device when the printing apparatus is moved relative to the print area along the first direction; and causing the printer to print the print image whose length has been adjusted on the printing medium when the printing apparatus is moved relative to the print area along a second direction that is different from the first direction, the print image being printed on the printing medium so as to extend in a direction along the first direction, wherein the causing the printer to print the print image comprises reading print data of the print image whose length has been adjusted in an order corresponding to the second direction when the printing apparatus is moved relative to the print area along the second direction, wherein the printing apparatus outputs an error notification when the first movement amount has exceeded a preset printing length, and wherein the printing apparatus cancels the error notification when an acquired length becomes equal to or less than the preset printing length as the printing apparatus is moved in the second direction after the first movement amount has exceeded the preset printing length, the acquired length being acquired by subtracting a second moving amount, which is an amount by which the printing apparatus is moved in the second direction after the first movement amount has exceeded the preset printing length, from the first moving amount.

11. The printing method of the printing apparatus according to claim 10, wherein:

the movement amount acquiring device is capable of acquiring a movement direction with respect to the printing medium when the printing apparatus is moved relative to the printing medium, the second direction is a direction substantially opposite to the first direction, and the method further comprises causing the printer to start printing when the movement direction acquired by the movement amount acquiring device is reversed.

12. The printing method of the printing apparatus according to claim 10, further comprising, in a case where the length of the print image is greater than the length of the print area, reducing the print image to a size falling within the print area, while maintaining an aspect ratio of the print image.

13. The printing method of the printing apparatus according to claim 10, further comprising, in a case where the length of the print image is smaller than the length of the print area and a height of the print image is smaller than a maximum value of a size printable by the printer, enlarging the print image to a size falling within the print area and printable by the printer, while maintaining an aspect ratio of the print image.

14. The printing method of the printing apparatus according to claim 13, further comprising, in a case where the length of the enlarged print image is smaller than the length of the print area, adding to the enlarged print image a space corresponding to a difference between the length of the print area and the length of the enlarged print image, and controlling the printer to print the enlarged print image, with the space added thereto, within the print area.

15. The printing method of the printing apparatus according to claim 10, further comprising, in a case where the length of the print image is smaller than the length of the print area and a height of the print image agrees with a maximum value of a size printable by the printer, adding to the print image a space corresponding to a difference between the length of the print area and the length of the print image, and controlling the printer to print the print image, with the space added thereto, within the print area.

* * * * *